US008215276B2

(12) United States Patent
Hendriksma

(10) Patent No.: US 8,215,276 B2
(45) Date of Patent: Jul. 10, 2012

(54) COMPACT SWITCHABLE HYDRAULIC LASH ADJUSTER WITH HYDRAULIC LOST MOTION ASSIST

(75) Inventor: Nick J. Hendriksma, Grand Rapids, MI (US)

(73) Assignee: Delphi Technologies, Inc., Troy, MI (US)

( * ) Notice: Subject to any disclaimer, the term of this patent is extended or adjusted under 35 U.S.C. 154(b) by 406 days.

(21) Appl. No.: 12/552,737

(22) Filed: Sep. 2, 2009

(65) Prior Publication Data

US 2011/0048352 A1 Mar. 3, 2011

(51) Int. Cl.
*F01L 1/14* (2006.01)

(52) U.S. Cl. ..... 123/90.52; 123/90.48; 123/90.55

(58) Field of Classification Search ..... 123/90.48, 123/90.52, 90.55
See application file for complete search history.

(56) References Cited

U.S. PATENT DOCUMENTS 6,164,255 A 12/2000 Maas et al.
6,196,175 B1 3/2001 Church
6,247,433 B1 6/2001 Faria et al.
6,345,596 B1 2/2002 Kuhl
6,427,652 B2 8/2002 Faria et al.
6,497,207 B2 12/2002 Spath et al.
6,513,470 B1 2/2003 Hendriksma et al.
6,578,535 B2 * 6/2003 Spath et al. ..... 123/90.16
6,606,972 B2 8/2003 Wenisch et al.
6,619,252 B2 * 9/2003 Haas et al. ..... 123/90.52
7,263,956 B2 9/2007 Spath et al.

OTHER PUBLICATIONS

Hendriksma, Nick J., "Switchable Valve Train Device Having a Single Locking Pin," U.S. Appl. No. 12/157,990, filed Jun. 16, 2008.

* cited by examiner

*Primary Examiner* — Ching Chang
(74) *Attorney, Agent, or Firm* — Thomas N. Twomey

(57) ABSTRACT

An improved deactivation hydraulic lash adjuster wherein the prior art lost motion spring or springs formerly located within the body of the DHLA and below the pin housing are either omitted completely or are reduced in length, spring force, and/or number and are augmented hydraulically, allowing a shorter, more compact lifter body and reduced overall lifter length. The prior art lost motion spring chamber becomes a hydraulic chamber connected to a new pressurized oil supply gallery containing an accumulator in the engine. An embodiment having no lost motion spring and solely hydraulic lost motion return can be even shorter than a spring-hydraulic hybrid because the potential hydraulic pressure to be brought against the pin housing is not a function of the length of the lost motion chamber, which length is limited only by the required displacement of the pin housing.

6 Claims, 6 Drawing Sheets

COMPACT SWITCHABLE HYDRAULIC LASH ADJUSTER WITH HYDRAULIC LOST MOTION ASSIST

TECHNICAL FIELD

The present invention relates to hydraulic lash adjusters (HLAs) for supporting roller finger followers in overhead-camshaft valvetrains in internal combustion engines; more particularly, to such HLAs having means for selectively engaging and disengaging activation of valves in valvetrains; and most particularly, to an improved deactivatable HLA wherein lost motion return of the pin housing and plunger is hydraulically assisted either with or without a lost motion spring.

BACKGROUND OF THE INVENTION

It is well known that overall fuel efficiency in a multiple-cylinder internal combustion engine can be increased by selective deactivation of one or more of the engine valves, under certain engine load conditions.

For an overhead-cam engine, a known approach is to equip the hydraulic lash adjusters for those valvetrains with means whereby the roller finger followers (RFFs) may be rendered incapable of transferring the cyclic motion of engine cams into reciprocal motion of the associated valves. Such lash adjusters are known in the art as Deactivating Hydraulic Lash Adjusters (DHLAs).

A prior art DHLA includes a conventional hydraulic lash adjuster disposed in a plunger having a domed head for engaging the RFF. The plunger itself is slidably disposed in a pin housing containing the lock pins which in turn is slidably disposed in a DHLA body. The pin housing may be selectively latched and unlatched hydromechanically to the body by the selective engagement of a spring and pressurized engine oil on the lock pins.

During engine operation in valve deactivation mode, the lock pins are withdrawn from locking features, typically an annular groove, in the body, and the pin housing is reciprocally driven in oscillation by the socket end of the RFF which pivots on its opposite pad end on the immobile valve stem as the cam lobe acts on the RFF. The pin housing is returned during half the lost motion reciprocal cycle by lost motion springs disposed within the body.

In a prior art DHLA, the required lost motion displacement is significantly larger than that of a comparable Deactivating Hydraulic Valve Lifter (DHVL) counterpart and so the packaging length in an engine is necessarily longer than desired. Prior art DHLAs represent compromises between packaging length and the maximum oil pressure capability of the device.

What is needed in the art is a shorter deactivating hydraulic lash adjuster.

It is a principal object of the present invention to reduce the length of a DHLA.

SUMMARY OF THE INVENTION

Briefly described, in a DHLA improved in accordance with the present invention, the prior art lost motion spring or springs formerly located within the body of the DHLA and below the pin housing are either omitted completely or are reduced in length, spring force, and/or number and augmented hydraulically. The lost motion spring chamber becomes a hydraulic chamber connected to a new pressurized oil supply gallery in the engine containing an accumulator. An embodiment having no lost motion spring and solely hydraulic lost motion return can be much shorter than either the prior art dual-spring embodiment or a spring-hydraulic hybrid because the chamber height does not need to accommodate the solid length of the lost motion spring(s). The body preferably is positively retained within the engine to prevent oil leakage under the DHLA from displacing the DHLA, thereby preventing the normal hydraulic lash adjustment function of the device.

Further, a typical prior art DHLA comprises dual opposed locking pins driven outwards by a spring therebetween. The spring chamber must be vented to the engine sump in some fashion, or else oil accumulated in the spring chamber will cause the pins be locked by the trapped oil and unretractable. Typically, a vent bore is provided into the lost motion spring chamber. A consequence of the improved lost motion return arrangement is that such an arrangement is no longer possible. A convenient solution to this problem is to provide only a single locking pin, and to vent the spring chamber laterally through a port in the housing sidewall. In one aspect of the invention, a single locking pin arrangement requires that the pin housing be prevented from rotation within the lifter body to permit the locking pin to engage reliably with a through-bore in the lifter body sidewall.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently preferred embodiments of the invention, and such exemplifications are not to be construed as limiting the scope of the invention in any manner.

DESCRIPTION OF THE PREFERRED EMBODIMENTS

Figure 1:
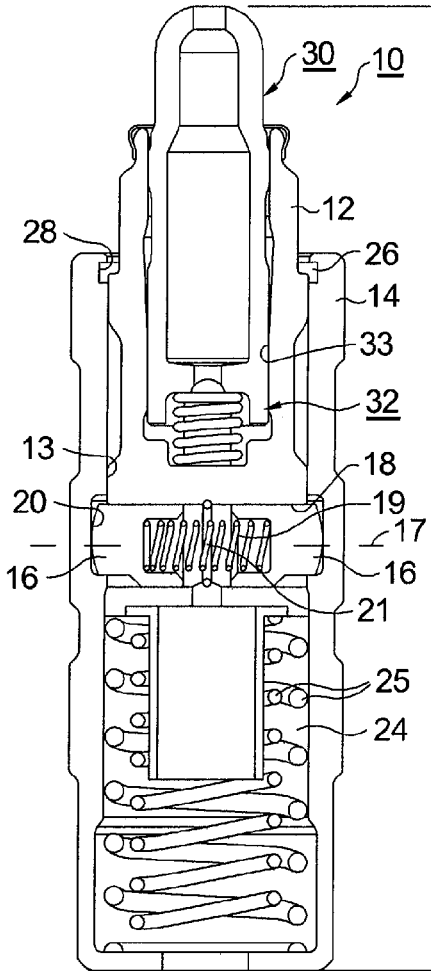
FIG. 1. (PRIOR ART)
FIG. 1 is an elevational cross-section view of a prior art DHLA having dual lost motion springs.

Referring to FIG. 1, a prior art deactivating hydraulic lash adjuster (DHLA) 10 comprises a pin housing 12 slidably disposed in an axial bore 13 in lash adjuster body 14. First and second opposed, spring-loaded lock pins 16 having an axis 17 are disposed in a transverse bore 18 in pin housing 12 and separated by a spring 19 for extending into a locking feature such as an annular groove 20 in the walls of body 14 to lock the two together during periods of engine operation in valve activation mode (as is shown in FIG. 1). A chamber 24 formed in body 14 below pin housing 12 contains one or more lost motion compression springs 25 for absorbing the reciprocating action ("lost" motion) of the pin housing during valve deactivation, and for urging pin housing 12 against lash clip 26 in groove 28 to position locking of pins 16 for engagement into groove 20. A hollow plunger assembly 30 containing a valvetrain lash adjustment mechanism 32 is slidably disposed in a bore 33 in pin housing 12.

Figure 4:
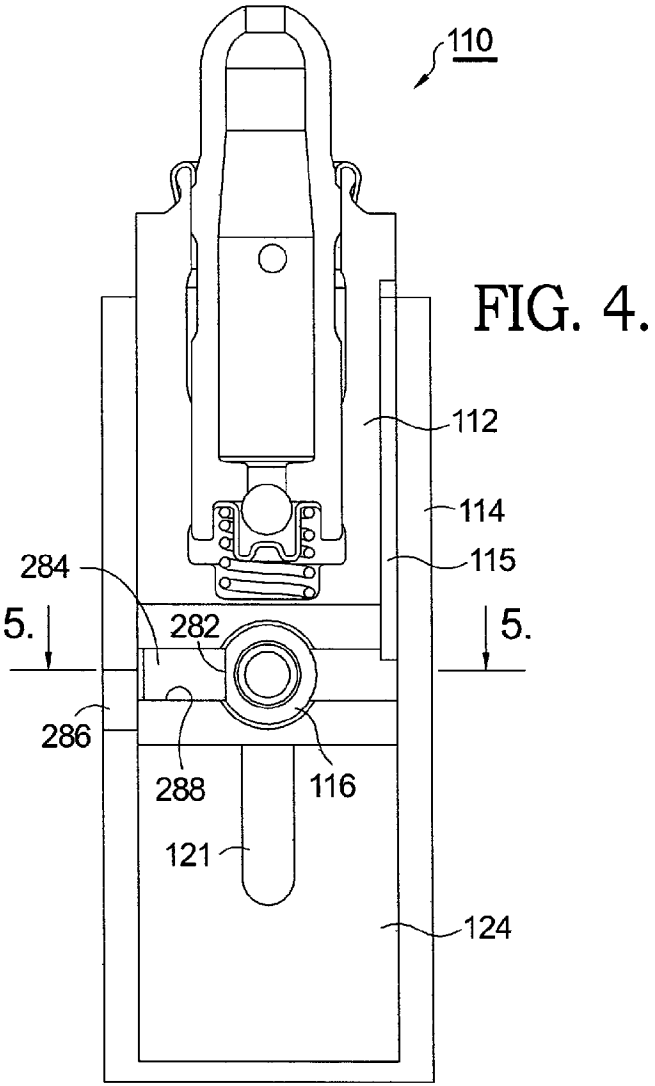
FIG. 4 is an elevational cross-sectional view of the improved DHLA shown in FIGS. 2 and 3, orthogonal to the view shown in FIG. 3.
Figure 3:
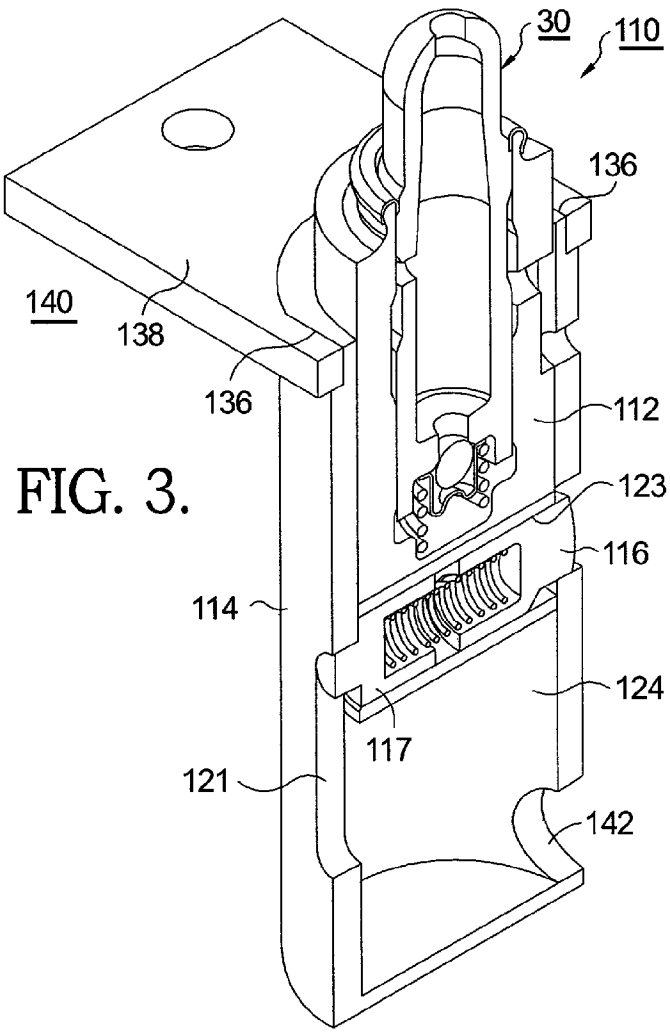
FIG. 3 is an elevational isometric view in cutaway of an improved DHLA having no lost motion springs and full hydraulic lost motion return assist.

Referring now to FIGS. 2 through 9, an improved DHLA 110 in accordance with the present invention comprises a pin housing 112 and hollow plunger assembly 30 slidably disposed in an axial bore 113 in lash adjuster body 114, analogous to prior art DHLA 10. Many components may be identical with those in the prior art, such as those comprising pin housing 112 and plunger assembly 30. The improvement consists in the following areas:

a) body 114 is substantially longitudinally shorter than body 14 and contains a shorter lost motion spring chamber 124 and one or more shorter, less powerful lost motion springs 125; thus, overall length 134 may be substantially reduced; length 134 may be reduced even further by eliminating springs 125 altogether and providing 100% hydraulic lost motion return. In the latter case, the length of the chamber 124 depends only on the desired amount of lost motion travel and does not need additional length related to the solid length of the lost motion springs.

b) annular groove 20 is replaced by a first shaped opening 120 extending through a wall of body 114 and an opposing second opening 121 extending through an opposite wall, which opening 121 defines a longitudinal slot;

c) optional parallel locking flats 136 may be provided for receiving a retainer 138 attached to engine 140 to axially retain (and prevent from rotation) DHLA 110 in a bore in engine 140 (various other obvious means for securing the DHLA within the engine bore are fully comprehended by the invention but not shown here);

d) a port 142 communicating directly with chamber 124 is provided for passage of pressurized oil as described below;

e) a single lock pin 116 is opposed by a shouldered anti-rotation plug 117 that slides in a longitudinal feature in body 114, preferably a longitudinal slot 121; pin 116 and plug 117 are urged apart by spring 119, and oil leakage into the cavity containing spring 119 is vented to atmosphere by way of channel 115 (FIG. 4).

Figure 2:
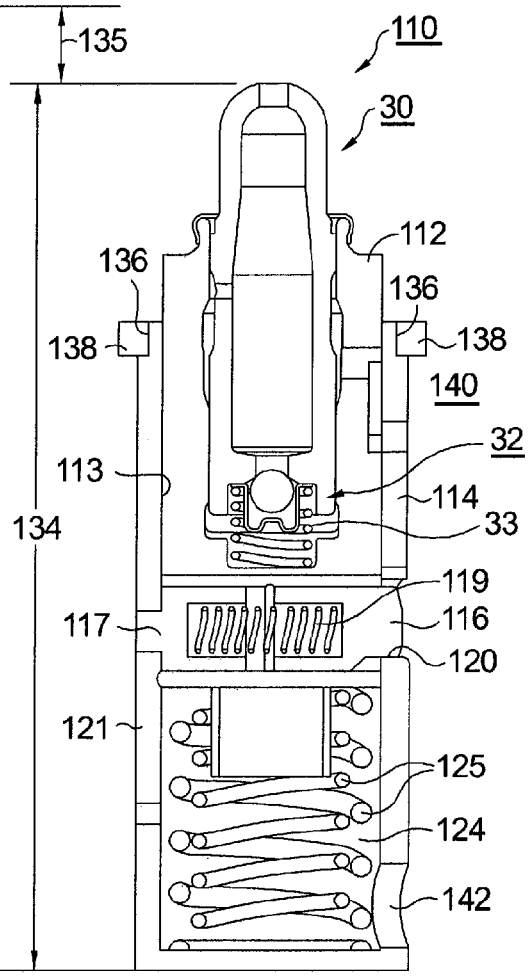
FIG. 2 is an elevational cross-sectional view of a first embodiment of an improved DHLA having either shortened (shown) or no lost motion springs (not shown) and hydraulic lost motion return assist.
Figure 10:
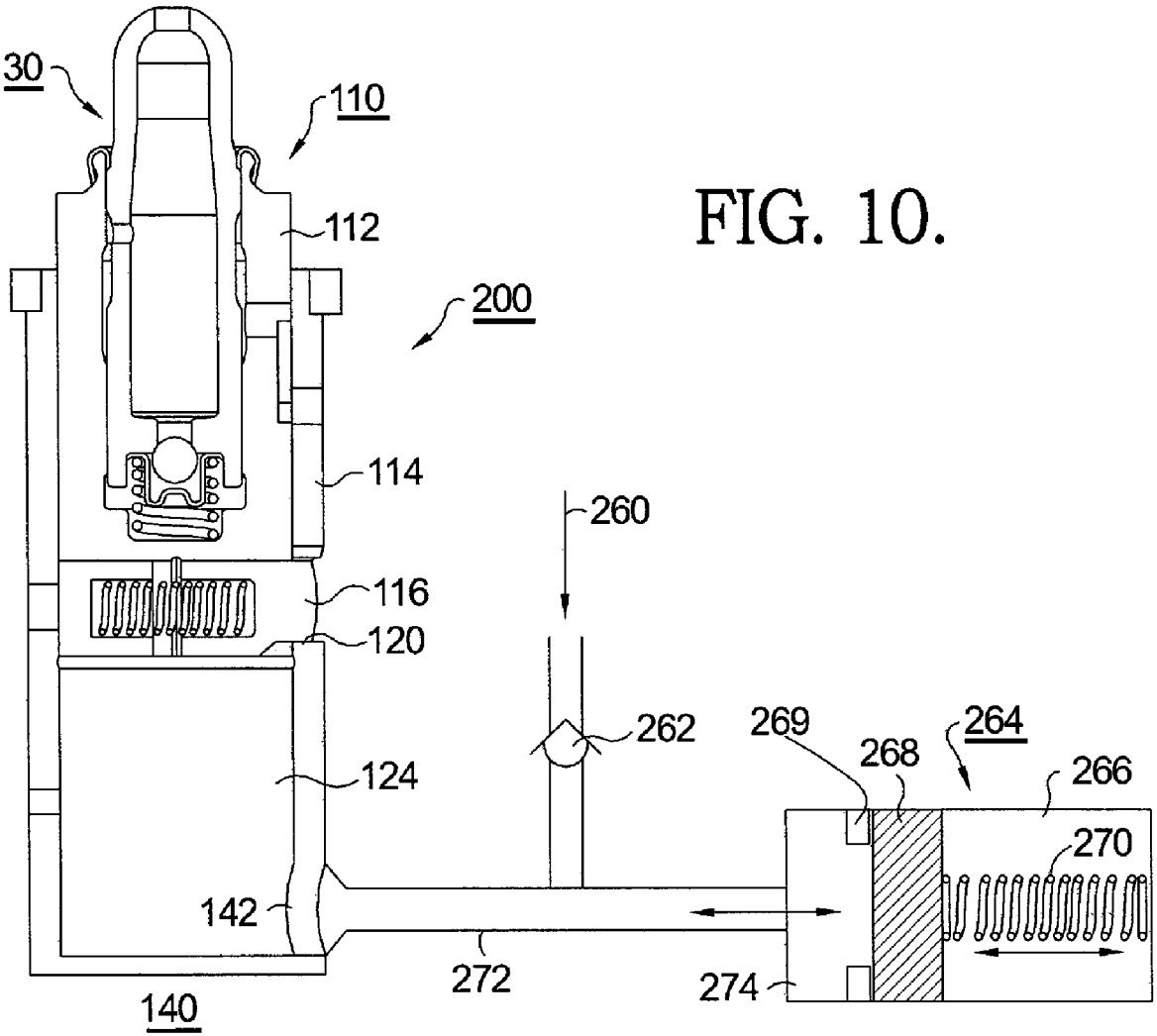
FIG. 10 is a schematic drawing of a system for employing a DHLA in accordance with the present invention, including a spring-biased accumulator.

Referring to FIGS. 2 and 10, a system 200 for providing lost motion return of a pin housing 112 and lash adjustment mechanism 30 in a DHLA 110 comprises a pressurized oil supply 260 connected to port 142 via a check valve 262 for preventing return of oil to supply 260. An exemplary accumulator 264 is also connected to port 142. Accumulator 264 includes a cylinder 266 containing a piston 268 in hydraulic communication with lost motion chamber 124. Piston 268 is backed by an accumulator spring 270 having a suitable pre-loaded length. In the pre-loaded position, with pin 116 in alignment for engagement with opening 120, piston stop 269 may be used to arrest further extension of spring 270. In that position, the pre-load exerted on piston 268 by spring 270 is selected to exceed the opposing hydraulic force exerted on piston 268 solely by pressurized oil supply 260.

In operation, system 200 is charged with pressurized oil in chamber 124 and hydraulic chamber 274 in accumulator 264 via dedicated oil gallery 272 in engine 140.

During valve deactivation mode of DHLA 110, when lock pin 116 is withdrawn from opening 120 in known fashion, pin housing 112 is displaced a predetermined distance within body 114 in lost motion in response to the action of an associated cam follower and cam lobe (not shown) in engine 140. The volume of chamber 124 is reduced and accumulator chamber 274 receives a volume of oil equal to the volume of oil displaced from lost motion chamber 124 by pin housing 112, thereby compressing spring 270 as piston 268 moves away from piston stop 269. As the associated cam follower returns to the base circle portion of the cam lobe, spring 270 urges oil in the reverse direction to refill chamber 124 in proportion to travel of pin housing 112, thus maintaining contact of the cam follower with the cam lobe. Oil volume lost from leakage past piston 268 is replenished immediately by supply 260. Because the area of the pin housing is greater than the area of the plunger, the hydraulic lash adjustment function is prevented from undesired expansion which would eliminate the necessary mechanical lash. A single accumulator 264 and oil gallery 272 may be connected to a plurality of DHLAs 110 in a multiple-valve engine, wherein gallery 272 defines a supply and return oil plenum for all the DHLAs.

Figure 5:
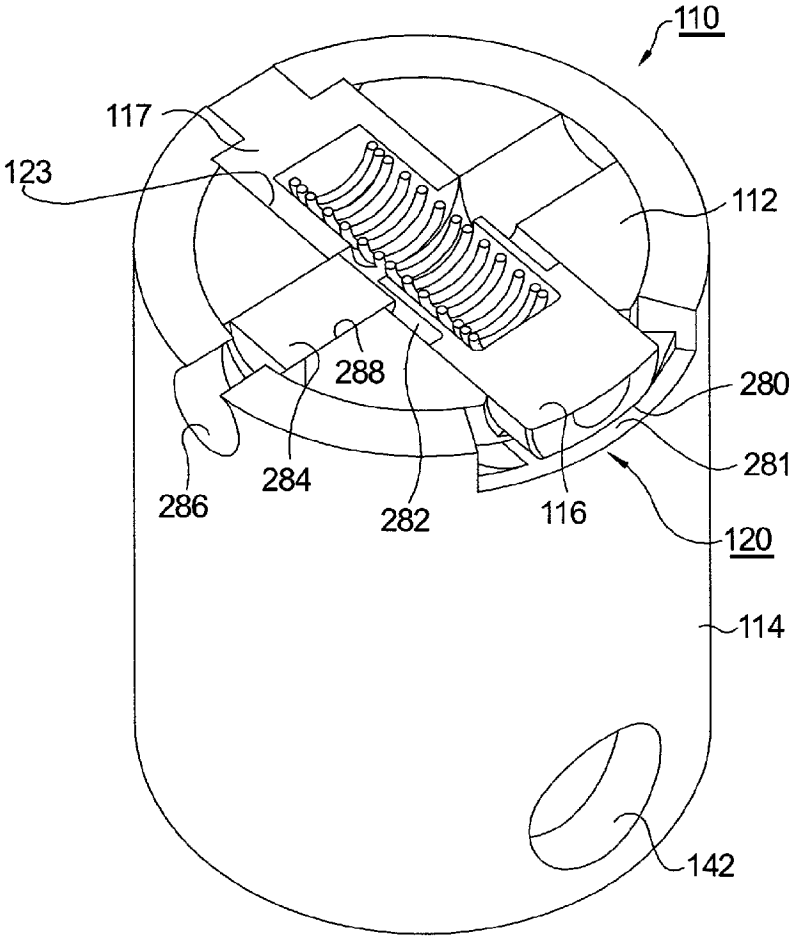
FIG. 5 is an elevational isometric view in cutaway, taken along line 5-5 in FIG. 4.
Figure 7:
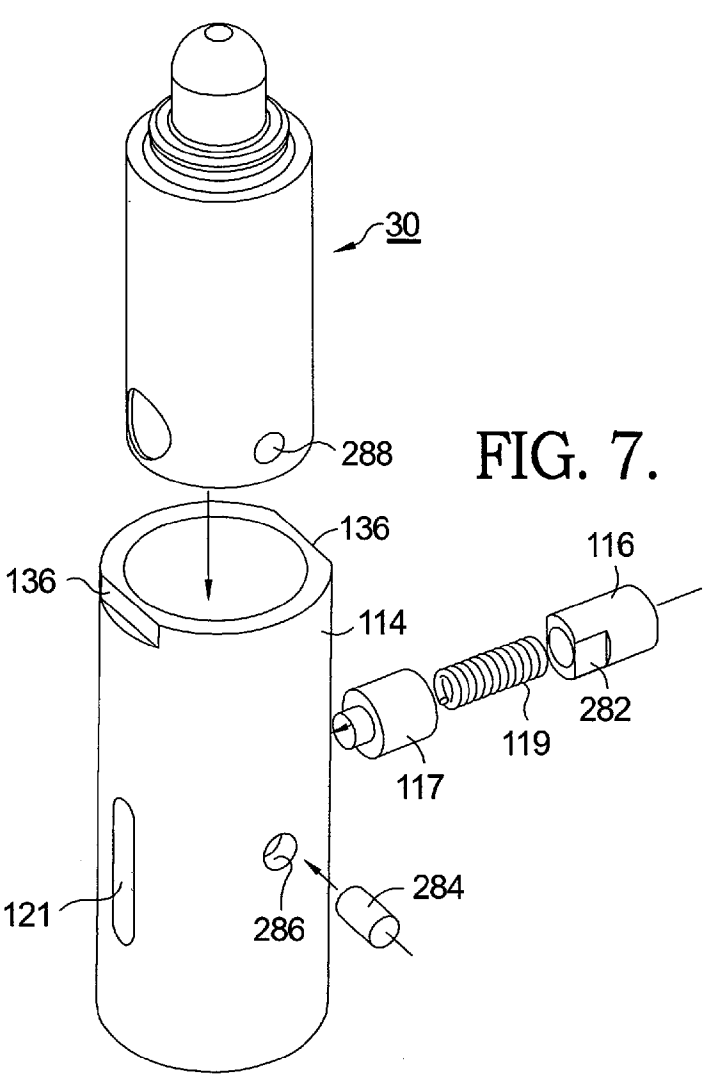
FIG. 7 is a second exploded isometric view of an improved DHLA taken from the opposite direction as the view in FIG. 6.

Referring now to FIGS. 4 through 7, locking pin 116 preferably includes a flat 280 for distributing the locking load on a mating flat 281 in shaped opening 120, which feature requires that locking pin 116 be prevented from rotation within pin housing 112. Accordingly, locking pin 116 is provided with a second flat 282 in a plane that may be orthogonal to a plane containing first flat 280, and an anti-rotation pin 284 is inserted through a bore 286 in body 114 into a bore 288 in pin housing 112 to engage second flat 282, thereby preventing pin 116 from rotation. Referring to FIG. 5, pin 284 protrudes slightly into the lock pin bore 123, thereby limiting the inward travel of plug 117 caused by oil pressure in chamber 124 acting on the outer face of plug 117.

Figure 6:
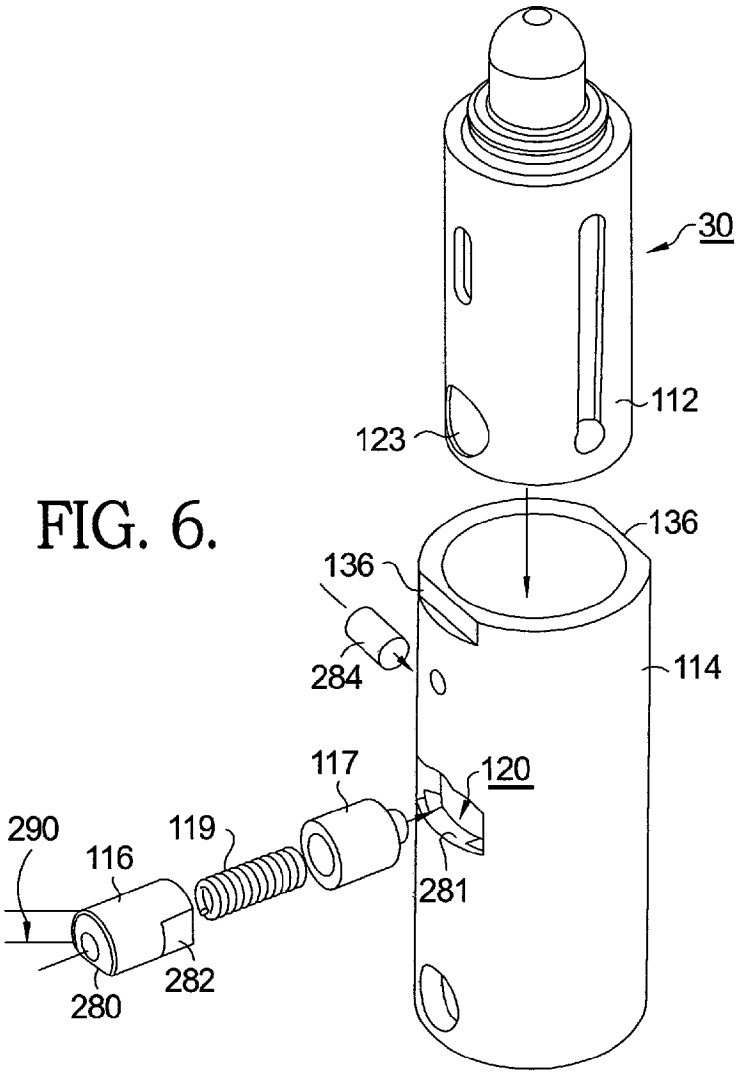
FIG. 6 is a first exploded isometric view of an improved DHLA.
Figures 8, 9:
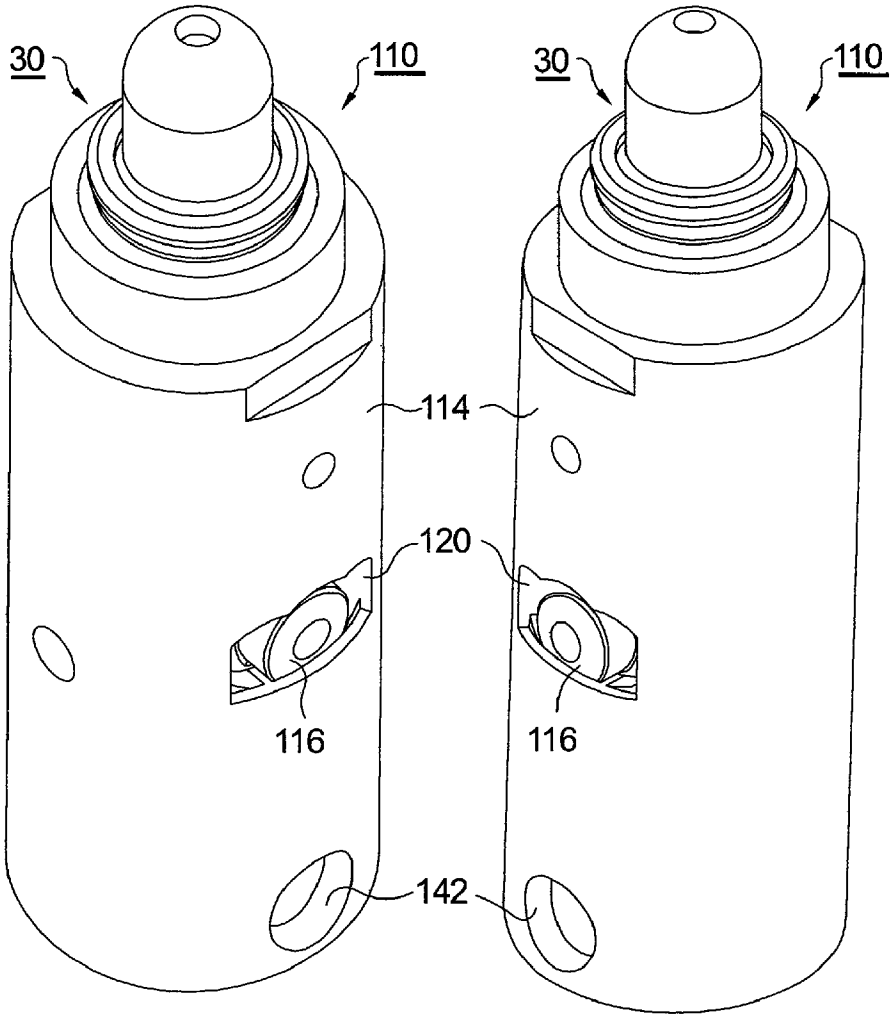
FIGS. 8 and 9 are two elevational isometric views of the improved DHLA shown in FIGS. 6 and 7 after assembly.

During assembly, pin housing 112 is inserted into body 114 to a depth that aligns opening 120 with transverse bore 123 (FIGS. 3 and 6) in pin housing 112 (FIG. 6). Plug 117, spring 119, and locking pin 116 are inserted through opening 120 into transverse bore 123. Pin 116 is further depressed into pin housing 112 against spring 119 until pin 116 no longer engages flat 281 in opening 120. Pin housing 112 is then depressed axially into body 114 until plug 117 seats into slot 121. Pin housing 112 is then depressed slightly farther to align bores 286 and 288. Anti-rotation pin 284 is installed as described above, and pin housing 112 is returned to alignment of bore 123 with opening 120, either via springs 125 (FIG. 2) or manually for the non-spring embodiment, to permit locking pin 116 to be thrust outwards by spring 119 into locking relationship with flat 281 (FIGS. 3-5 and 8-10.)

To establish locking pin clearance (mechanical lash) between opening flat 281 and locking pin flat 280 to assure locking pin engagement with opening 280, a locking pin gage may be substituted first for the locking pin 116 in the above step to determine the gap between opening flat 281 and the gage. Then, a locking pin 116 having a select locking pin flat dimension 190 (FIG. 6) may be installed in place of the gage to complete the above step and to achieve the desired mechanical lash. After mechanical lash is set, the improved DHLA 110 is now ready for installation into engine 140 and securing in place by retainer 138.

In the embodiment wherein one or more lost motion springs are included in chamber 124, the pre-load of the spring(s) should be selected to be greater than the expansion force of spring 33 in lash adjustment mechanism 32 (FIG. 2) to prevent spring 33 from "pumping down" pin housing 112 after engine shut-down. In the embodiment wherein no lost motion springs are used, in order to prevent pin housing "pump-down" by spring 33, the control system providing hydraulic pressure to the locking pin should assure that pins 116 are engaged in openings 120 before the engine shut-down sequence begins.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A system for providing selective deactivation of a valve in an internal combustion engine, comprising:

a) a deactivation mechanism including a body having an axial bore; a housing slidably disposed in said axial bore wherein said body and said housing conjunctively define a hydraulic chamber adjacent an end of said housing, said hydraulic chamber configured for receiving pressurized oil; a locking mechanism for selectively preventing axial translation of said housing into said body; wherein said body includes a port for admittance of said pressurized oil into said chamber;

b) a pressurized oil supply for supplying said pressurized oil into said chamber via an oil gallery; and c) an accumulator in communication with said gallery for receiving a volume of oil substantially equal to the volume of oil displaced from said chamber during lost motion of said housing.

2. A system in accordance with claim 1 further comprising a check valve disposed in said gallery between said pressurized oil supply and said accumulator and said body.

3. A system in accordance with claim 1 wherein said accumulator comprises:

a) a cylinder;

b) a piston slidably disposed within said cylinder and in oil communication with said gallery on a first side thereof; and c) a bias spring disposed within said cylinder and operative again a second side of said piston.

4. A system in accordance with claim 1 comprising a plurality of said deactivation mechanism for variably deactivating a plurality of valves in a multiple-valve engine, wherein said plurality of deactivation mechanisms are connected in parallel to a single pressurized oil supply and accumulator.

5. A system in accordance with claim 1 wherein said locking mechanism includes a lock pin and a plug disposed in axial alignment with said lock pin, and wherein said body includes a longitudinal slot for receiving an end of said plug and wherein a spring is disposed between said at lock pin and said plug.

6. An internal combustion engine comprising a system for providing selective deactivation of a valve in an internal combustion engine, wherein said system includes, a deactivation mechanism including a body having an axial bore; a housing slidably disposed in said axial bore wherein said body and said housing conjunctively define a hydraulic chamber adjacent an end of said housing, said hydraulic chamber configured for receiving pressurized oil; a locking mechanism for selectively preventing axial translation of said housing into said body; wherein said body includes a port for admittance of said pressurized oil into said chamber, a pressurized oil supply for supplying said pressurized oil into said chamber via an oil gallery, and an accumulator in communication with said gallery for receiving a volume of oil substantially equal to the volume of oil displaced from said chamber during lost motion of said housing.

* * * * *